United States Patent [19]

Kepplinger et al.

[11] 4,010,673

[45] Mar. 8, 1977

[54] SMALL ARM

[75] Inventors: Hannes Kepplinger, Kufstein; Hermann Schweighofer, Steyr, both of Austria

[73] Assignee: Steyr-Daimler-Puch Aktiengesellschaft, Vienna, Austria

[22] Filed: Nov. 7, 1975

[21] Appl. No.: 629,696

[30] Foreign Application Priority Data

Nov. 28, 1974 Austria ..... 9560/74

[52] U.S. Cl. ..... 89/191 A; 89/193; 89/196

[51] Int. Cl.[2] ..... F41D 11/12

[58] Field of Search ..... 89/191 A, 193, 196, 89/180

[56] References Cited

UNITED STATES PATENTS

| | | | |
|---|---|---|---|
| 2,554,618 | 5/1951 | Dixon | 89/193 |
| 3,261,264 | 7/1966 | Wilson | 89/191 A |
| 3,273,460 | 9/1966 | Mason | 89/191 A X |
| 3,886,844 | 6/1975 | Kepplinger et al. | 89/191 A |

*Primary Examiner*—David H. Brown
*Attorney, Agent, or Firm*—Kurt Kelman

[57] ABSTRACT

A barrel is fixedly inserted in and protrudes from a grip and comprises a barrel chamber. A piston is provided on the outside of said barrel and rigid therewith. A breechblock comprises a cylinder surrounding said barrel and piston before said grip and defining with said barrel an annular chamber, which is sealed against said barrel. Said breechblock is movable along said barrel to and from a forward position. A counterrecoil spring urges said breechblock to said forward position. A piston is disposed in said annular chamber and rigid with said barrel and arranged to be disposed at the rear end of said annular chamber when said breechblock is in said forward position. Transverse bore means are formed in said barrel and communicate with the interior of said barrel adjacent to said barrel chamber. Longitudinal passage means are provided, which are laterally enclosed and connect said transverse bore means to said annular chamber.

2 Claims, 2 Drawing Figures

SMALL ARM

Figure 1:
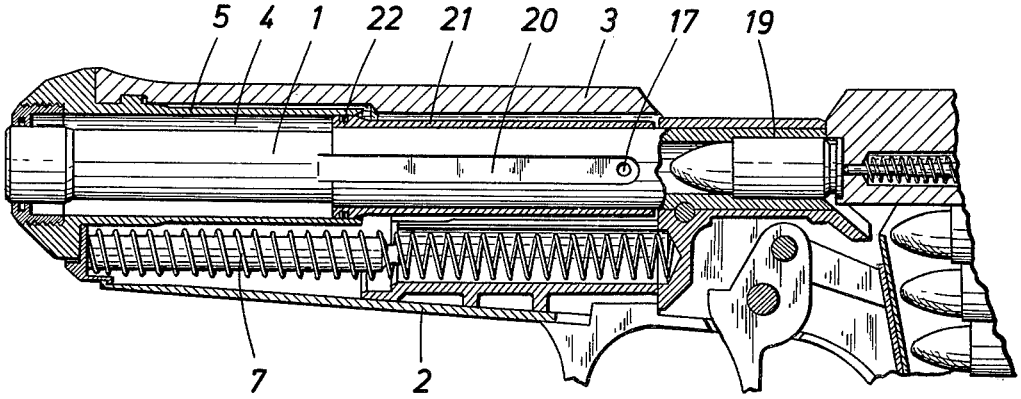

This invention relates to a small arm, particularly a pistol, which comprises a barrel, which is firmly inserted in the grip, and a breechblock, which encloses the forward portion of the barrel and is adapted to be pushed back against the force of a counterrecoil spring and which is not adapted to be locked to the barrel, wherein that portion of the breechblock which surrounds the barrel serves as a cylinder, which defines an annular chamber, which is sealed against the barrel, the barrel forms a piston which is disposed adjacent to the rear end of the cylinder, and the barrel is provided with at least one transverse bore which opens into the annular chamber.

In this arrangement, the powder gases entering the annular chamber brake the recoil movement of the breechblock so that a relatively small mass of the breechblock is sufficient.

In an embodiment of a known small arm of this type, the transverse bores which connect the annular chamber with the barrel bore are disposed before the barrel chamber at a large distance therefrom so that the breechblock has already a considerable velocity when the shot has been fired and the breechblock has pulled the cartridge case a considerable distance out of the barrel chamber before pressure can build up in the annular chamber. With cartridges having a strong charge, the remaining time in which pressure is applied until the bullet leaves the barrel may no longer be sufficient for a sufficient retardation of the breechblock so that the cartridge cases may break because they are excessively extracted when the full gas pressure is still applied. Replaceable end caps must be provided for the cylinder which defines the annular chamber because end caps having different passage openings are required for an adaptation to cartridges having charges of different strengths so that for weaker propelling charges the braking action can be reduced by a release of gas from the annular chamber whereas for stronger charges the gas pressure is maintained as high as possible so that the breechblock can be sufficiently braked although it has been highly accelerated before the braking action begins. The users of the pistol may even forget to replace the end cap when using another type of cartridge.

It is an object of the invention so to improve the above-described small arm, particularly a pistol, that a breakage of cartridge cases is reliably avoided and propelling charges of different strengths may be selected without need for a replacement of parts.

This object is accomplished according to the invention in that the transverse bore or tranverse bores is or are disposed a small distance before the barrel chamber and is or are connected to the annular chamber by a closed longitudinal passage or respective longitudinal passages.

When the transverse bore or transverse bores are thus arranged, the braking action exerted by the powder gases begins immediately after the firing of the shot so that the recoiling breechblock cannot reach an excessively high velocity even though the breechblock has a relatively small mass. A breakage of cartridge cases is thus prevented. The gas pressure in the barrel on the path traversed by the bullet until it leaves the muzzle exhibits adjacent to the barrel chamber a rise which is highly dependent on the propelling charge. On the other hand, the gas pressure in the forward portion of the barrel is much less dependent on the strength of the propelling charge. For this reason, when the powder gases used for braking are taken from adjacent to the barrel chamber, they will exert a stronger braking action in the case of stronger propelling charges and the braking action will then be automatically adapted to the strength of the propelling charge which has been fired. As a result, there is no need to provide the braking cylinder with replaceable end caps having pressure relief bores. Because the annular chamber is connected to the transverse bores in the barrel by relatively long connecting passages, the powder particles entering the annular chamber cannot get back into the barrel, particularly into the barrel chamber, when the gas pressure is relieved after the shot, so that these powder particles cannot interfere with the loading of the arm. The powder particles cannot move back through the narrow, closed passages, which act like check valves. Any residue in the annular chamber will not be distributing because it will be blown out at the next shot through the gap which is then formed adjacent to the muzzle.

According to a further feature of the invention, the or each longitudinal passage is constituted by a groove which is formed on the outside surface of the barrel and covered by a sleeve fitted on the barrel, and the forward end portion of the sleeve serves as a piston so that the structure is comparatively simple and can be manufactured in a simple manner.

Figure 2:
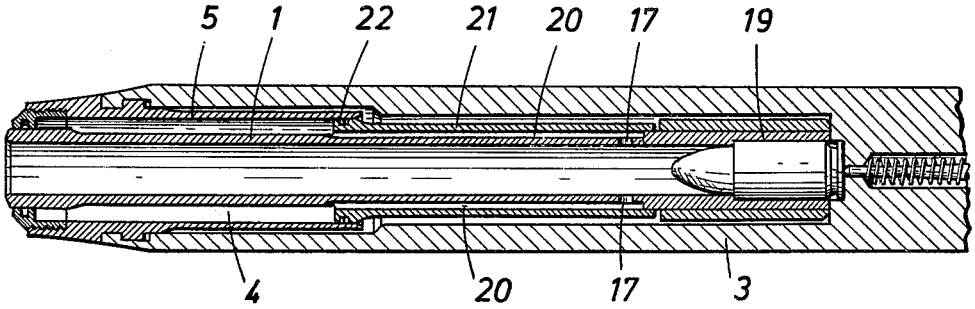

An embodiment of the invention is shown by way of example on the accompanying drawing, in which FIGS. 1 and 2 are, respectively, a vertical and a horizontal longitudinal sectional view showing the forward part of a pistol and taken through the axis of the barrel.

The barrel 1 of the pistol is fixedly inserted in the grip 2, which is shown only in part. The breechblock 3 is mass-controlled and is slidably guided on the grip 2. The breechblock 3 extends forwardly as far as to the muzzle and is locked there to a cylinder 5, which surrounds the barrel 1 and defines an annular chamber 4 therewith. A counterrecoil spring 7 bears at its rear end on a part that is fixed to the grip 2 and serves to advance the breechblock 3 to its closing position when it has recoiled after the shot.

The barrel 1 is provided with two transverse bores 17, which are disposed a small distance before the barrel chamber 19 and are connected to the annular chamber 4 by closed longitudinal passages. These longitudinal passages are constituted by grooves 20, which are formed on the outside of the barrel and covered by a sleeve 21, which is pushed over the barrel 1 and is fixed thereto. The forward end portion 22 of the sleeve serves as a piston, which slides in the annular chamber 4 relative to the cylinder 5.

What is claimed is:

1. A small arm comprising a. a grip, b. a barrel fixedly inserted in the grip, the barrel having 1. a forward end protruding from the grip,
2. a rear end,
3. a barrel chamber at the rear end, and
4. transverse bore means adjacent the barrel chamber, c. a breechblock surrounding the barrel and reciprocably movable therealong to and from a forward position, the breechblock being resiliently biased into the forward position and including 1. a cylinder surrounding the barrel and defining a sealed annular chamber with the barrel adjacent the forward end thereof, the annular chamber having a rear end spaced from the barrel chamber forwardly of the transverse bore means, and 2. the barrel having affixed thereto a piston disposed at the rear end of the annular chamber when the breechblock is in the forward position, and d. circumferentially enclosed and longitudinally extending passage means connecting the rearwardly disposed transverse bore means of the barrel to the forwardly disposed annular chamber.

2. The small arm of claim 1, further comprising a sleeve surrounding the barrel and having a rear end adjacent the barrel chamber, the rear sleeve end extending over the transverse bore means in the barrel, and a forward end constituting the piston, the longitudinally extending passage means being defined by one or more longitudinal grooves in the barrel and the groove or grooves being circumferentially enclosed by the sleeve.

* * * * *